US011114806B2

(12) United States Patent
Zushi et al.

(10) Patent No.: US 11,114,806 B2
(45) Date of Patent: Sep. 7, 2021

(54) COAXIAL CONNECTOR DEVICE HAVING MAIN CONNECTOR TO WHICH CABLE IS CONNECTED AND BOARD CONNECTOR TO WHICH MAIN CONNECTOR IS CONNECTED

(71) Applicant: Canare Electric Co., Ltd., Aichi (JP)

(72) Inventors: Hiroshi Zushi, Tokyo (JP); Motoki Ogasawara, Tokyo (JP); Daisuke Murakami, Tokyo (JP)

(73) Assignee: CANARE ELECTRIC CO., LTD., Aichi (JP)

( * ) Notice: Subject to any disclaimer, the term of this patent is extended or adjusted under 35 U.S.C. 154(b) by 0 days.

(21) Appl. No.: 16/642,263

(22) PCT Filed: Sep. 7, 2018

(86) PCT No.: PCT/JP2018/033315
§ 371 (c)(1),
(2) Date: Feb. 26, 2020

(87) PCT Pub. No.: WO2020/049743
PCT Pub. Date: Mar. 12, 2020

(65) Prior Publication Data
US 2021/0151943 A1 May 20, 2021

(51) Int. Cl.
*H01R 24/54* (2011.01)
*H01R 12/72* (2011.01)
(Continued)

(52) U.S. Cl.
CPC ..... *H01R 24/54* (2013.01); *H01R 12/721* (2013.01); *H01R 24/42* (2013.01); *H01R 24/50* (2013.01);
(Continued)

(58) Field of Classification Search
CPC .. H01R 2103/00; H01R 12/52; H01R 9/0515; H01R 12/714; H01R 13/6464;
(Continued)

(56) References Cited

U.S. PATENT DOCUMENTS

2003/0045166 A1* 3/2003 Kikuchi ..... H01R 24/542 439/578

* cited by examiner

*Primary Examiner* — Abdullah A Riyami
*Assistant Examiner* — Justin M Kratt
(74) *Attorney, Agent, or Firm* — Procopio, Cory, Hargreaves & Savitch LLP

(57) ABSTRACT

There is provided a coaxial connector device that enables a reduction in deterioration in signal quality and transmission characteristics at high frequencies. A coaxial connector device 1 includes a main connector 10 and a board connector 20. A main connector body 11 has a first fitting part R1 for a coaxial cable connector at one end and a second fitting part R2 at the other end. Inside the main connector body 11, a center contact 13 and a card edge substrate 17 electrically connected to the center contact 13 are included. In a board connector body 21 a slot 23 is formed. When the second fitting part R2 of the main connector 10 is fitted to the board connector 20, the end portion of the card edge substrate 17 is coupled to the slot 23 of the board connector body 21, a plurality of substrate contacts included in the card edge substrate 17 electrically contacts a plurality of inner contacts 25 of the board connector body 21, and the second fitting part R2 of the main connector body 11 electrically contacts an outer conductor contact 27.

8 Claims, 9 Drawing Sheets

(51) Int. Cl.

| | |
|---|---|
| ***H01R 24/42*** | (2011.01) |
| ***H01R 24/50*** | (2011.01) |
| *H01R 13/646* | (2011.01) |
| *H01R 9/05* | (2006.01) |
| *H01R 13/66* | (2006.01) |
| *H01R 12/52* | (2011.01) |
| *H01R 12/71* | (2011.01) |
| *H01R 103/00* | (2006.01) |
| *H01R 12/73* | (2011.01) |
| *H01R 13/719* | (2011.01) |
| *H01R 13/6464* | (2011.01) |
| *H01R 24/40* | (2011.01) |

(52) U.S. Cl.

CPC ..... *H01R 9/0515* (2013.01); *H01R 12/52* (2013.01); *H01R 12/714* (2013.01); *H01R 12/72* (2013.01); *H01R 12/73* (2013.01); *H01R 13/646* (2013.01); *H01R 13/6464* (2013.01); *H01R 13/665* (2013.01); *H01R 13/6608* (2013.01); *H01R 13/6658* (2013.01); *H01R 13/719* (2013.01); *H01R 24/40* (2013.01); *H01R 24/542* (2013.01); *H01R 2103/00* (2013.01)

(58) Field of Classification Search

CPC .. H01R 13/6608; H01R 13/719; H01R 24/40; H01R 13/6658; H01R 24/542; H01R 12/72; H01R 12/73; H01R 13/665; H01R 13/646; H01R 24/54; H01R 24/42; H01R 24/50; H01R 12/721

USPC ..... 439/578, 63, 638

See application file for complete search history.

(A)

(B)

PRIOR ART

COAXIAL CONNECTOR DEVICE HAVING MAIN CONNECTOR TO WHICH CABLE IS CONNECTED AND BOARD CONNECTOR TO WHICH MAIN CONNECTOR IS CONNECTED

CROSS-REFERENCE TO RELATED APPLICATIONS

This application is a U.S. National Stage entry of PCT Application No: PCT/JP2018/033315 filed on Sep. 7, 2018, the contents of which are incorporated herein by reference.

TECHNICAL FIELD

The present invention relates to a coaxial connector device, and more particularly to a coaxial connector device for electrically connecting a coaxial cable attached with a connector and a printed circuit board.

BACKGROUND ART

Various coaxial connectors for electrically connecting a coaxial cable attached with a connector and a printed circuit board are already known (e.g. Patent Literatures 1 and 2).

A coaxial connector disclosed in Patent Literature 1 includes an inner conductor, an outer conductor in a cylindrical shape coaxial with the inner conductor, and an insulating base that fixes the inner conductor to the outer conductor in an electrically insulated state. The inner conductor is a slim conductor, and the inner conductor includes a connecting part to a printed circuit board inside an apparatus and a jack part that receives the conductor wire of a coaxial cable. The outer conductor includes a contacting part with an outer conductor ground contact and a receiving part for the coaxial cable. The ground contact includes a connecting part to the printed circuit board inside the apparatus and a contacting part with the outer conductor.

An active connector disclosed in Patent Literature 2 includes a connector base having at least one active element within the base, an external port electrically coupled to a transmission line, and an internal port electrically coupled to a printed circuit board inside an apparatus. The internal port includes a plurality of terminal pins protruding from the side surface of the connector base. The plurality of terminal pins includes a ground terminal, a signal terminal(s), and a direct-current voltage supply terminal. On the side surface of the connector base, a ground lug is provided. The ground lug includes a pair of ground lug pins. FIG. 9 shows an exemplary configuration of a previously existing active connector 80, where 81 denotes a connector base, 83 denotes an internal printed circuit board on which an active element is mounted, 85 denotes terminal pins, 87 denotes a ground lug, and 87*a* denotes ground lug pins.

CITATION LIST

Patent Literature

Patent Literature 1: Japanese Unexamined Patent Application Publication No. 2003-151693

Patent Literature 2: Japanese Unexamined Patent Application Publication No. 2012-54030

SUMMARY OF INVENTION

Technical Problem

In fixing a coaxial connector to an apparatus, terminals (such as connecting parts or terminal pins) of the coaxial connector are inserted into holes formed in a printed circuit board inside the apparatus, and as such the coaxial connector is electrically connected to a circuit formed on the printed circuit board.

For example, in the coaxial connector disclosed in Patent Literature 1, the connecting part of the inner conductor and the connecting part of the outer conductor are inserted into the holes formed in the printed circuit board inside the apparatus, and then soldered. Similarly, in the active connector disclosed in Patent Literature 2, one end of each of the plurality of terminal pins 85 and the ground lug pins are inserted into holes formed in the printed circuit board inside the apparatus and soldered. The other end of each of the plurality of terminal pins 85 is inserted into a hole formed in the internal printed circuit board 83 in the connector base 81 and soldered.

Various broadcasting equipment that conforms to 4K/8K broadcasting is being developed, and some broadcasting apparatuses have been in practical use. As interface standards for connecting such broadcasting apparatuses each other, 3G-SDI (Serial Digital Interface) having a transmission rate of 3 gigabits per second (Gb/s) and 12G-SDI having a transmission rate of 12 Gb/s have been standardized. In these interface standards, high electrical performance and reliability are required for wiring systems of equipment. Therefore, a connector for connecting a transmission line (a coaxial cable) and an apparatus is desired such that the connector is designed and mounted to minimize deterioration in signal quality and signal characteristics.

In the coaxial connector disclosed in Patent Literature 1, when the connecting part of the inner conductor is inserted into the holes foiled in the printed circuit board inside the apparatus, the tips of the connecting parts protrude from the back surface of the printed circuit board to form stubs. Similarly, also in the active connector disclosed in Patent Literature 2 as illustrated in FIG. 9, when a plurality of terminal pins 85 are inserted into the holes formed in a printed circuit board inside an apparatus, the tips of the terminal pins protrude from the back surface of the printed circuit board to form stubs.

In addition to this, as illustrated in FIG. 9, in the previously existing active connector, when the other ends of the plurality of terminal pins 85 are inserted into the holes formed in the printed circuit board 83 built in the connector base 81, the tips of the other ends protrude from the front surface of the printed circuit board, resulting in forming stubs.

Stubs protruding from the front/back surface of a printed circuit board as described above are called via stubs or dangling via stubs. These stubs cause deterioration of signal quality and transmission characteristics at a radio frequency or at a higher frequency. Therefore, for connectors that conform to standards for extremely high-speed signal transmission such as 12G-SDI, solving the stub problem described above is desired.

Moreover, when connecting the previously existing connector to the printed circuit board, the connecting parts of the inner and outer conductors, the terminal pins, and the ground lug pins are manually soldered from the back surface of the printed circuit board. Therefore, there is room for improvement of connecting work efficiency. There is also a problem that, when the connector has to be detached after the connector is once mounted, it takes time and effort to detach the connector.

Therefore, an object of the present invention is to provide a coaxial connector device that enables a reduction in deterioration of signal quality and transmission characteristics at high frequencies.

An object of the present invention is to provide a coaxial connector device that enables the improvement of connecting work efficiency to a printed circuit board.

Solution to Problem

In order to solve the problems, a coaxial connector device according to the present invention is a coaxial connector device for electrically connecting a coaxial cable connector and a printed circuit board, the device including a main connector, and a board connector to be mounted on a printed circuit board. The main connector includes a conductive main connector body having a first fitting part for a coaxial cable connector at one end and a second fitting part at the other end, a center contact positioned, inside the main connector body, on a side with the first fitting part, and a card edge substrate positioned, inside the main connector body, on a side with the second fitting part side, the card edge substrate being electrically connected to the center contact. The board connector includes a board connector body in which a slot is formed, the board connector body being provided with a plurality of contacts in the slot, and an outer conductor contact provided in the board connector body. When the second fitting part of the main connector is fitted to the board connector, an end portion of the card edge substrate is coupled to the slot of the board connector body, a plurality of substrate contacts included in the card edge substrate electrically contact the plurality of contacts of the board connector body, and the second fitting part of the main connector body electrically contacts the outer conductor contact.

In a preferred embodiment of the coaxial connector device according to the present invention, the second fitting part may have an inner face that contacts at least the outer conductor contact when the second fitting part is fitted to the board connector.

In a preferred embodiment of the coaxial connector device according to the present invention, the inner face of the second fitting part of the main connector may be cylindrical or semi-cylindrical, and the outer conductor contact of the board connector may include a spring member provided outside the board connector body.

In a preferred embodiment of the coaxial connector device according to the present invention, each of the plurality of contacts of the board connector and the outer conductor contact may have a connection terminal extending from a bottom part or bottom face of the board connector body in a width direction of the board connector.

In a preferred embodiment of the coaxial connector device according to the present invention, the connection terminals of the board connector may be configured such that when the board connector is mounted on a surface of a printed circuit board, the connection terminals are connected to respective wirings on the printed circuit board.

In a preferred embodiment of the coaxial connector device according to the present invention, the card edge substrate of the main connector may include at least one active circuit.

In addition to this, in a preferred embodiment of the coaxial connector device according to the present invention, the active circuit may include at least a first matching circuit, a second matching circuit connected to the center contact, and a buffer circuit provided between the first matching circuit and the second matching circuit.

In a preferred embodiment of the coaxial connector device according to the present invention, the slot of the board connector may be formed such that, when the board connector is mounted on a printed circuit board, the slot is oriented at a predetermined angle with respect to one face of the printed circuit board or in parallel with the one face of the printed circuit board.

Advantageous Effects of Invention

In the coaxial connector device according to the present invention, the main connector includes the center contact positioned, inside the main connector body, on a side with the first fitting part, and the card edge substrate positioned, inside the main connector body, on a side with the second fitting part, the card edge substrate being electrically connected to the center contact. On the other hand, the board connector that is fitted to the second fitting part of the main connector includes the board connector body in which the slot is formed and which is provided with the plurality of contacts in the slot, and the outer conductor contact provided in the board connector body. When the second fitting part of the main connector is fitted to the board connector, the end portion of the card edge substrate is coupled to the slot in the board connector body, the plurality of substrate contacts included in the card edge substrate electrically contact the plurality of contacts of the board connector body, and the second fitting part of the main connector electrically contacts the outer conductor contact. Accordingly, the coaxial connector according to the present invention can be mounted on the printed circuit board so as not to form any stub, and a reduction in deterioration of signal quality and transmission characteristics at high frequencies can be enabled.

In the coaxial connector device according to the present invention, the main connector can be configured detachably from the board connector. Accordingly, this enables the work that fits the main connector to the board connector after the board connector is mounted on the surface of the printed circuit board, and hence connecting work efficiency of connecting the coaxial connector device to a printed circuit board can be improved.

The objects and advantages of the present invention described above and other objects and advantages will be understood more clearly through the following description of embodiments. Of course, in the following, an embodiment to be described below is merely an example, and the present invention is not limited to the embodiment.

DESCRIPTION OF EMBODIMENTS

In the following, preferable embodiments of a coaxial connector device according to the present invention will be described in detail with reference to the drawings.

Figure 1:
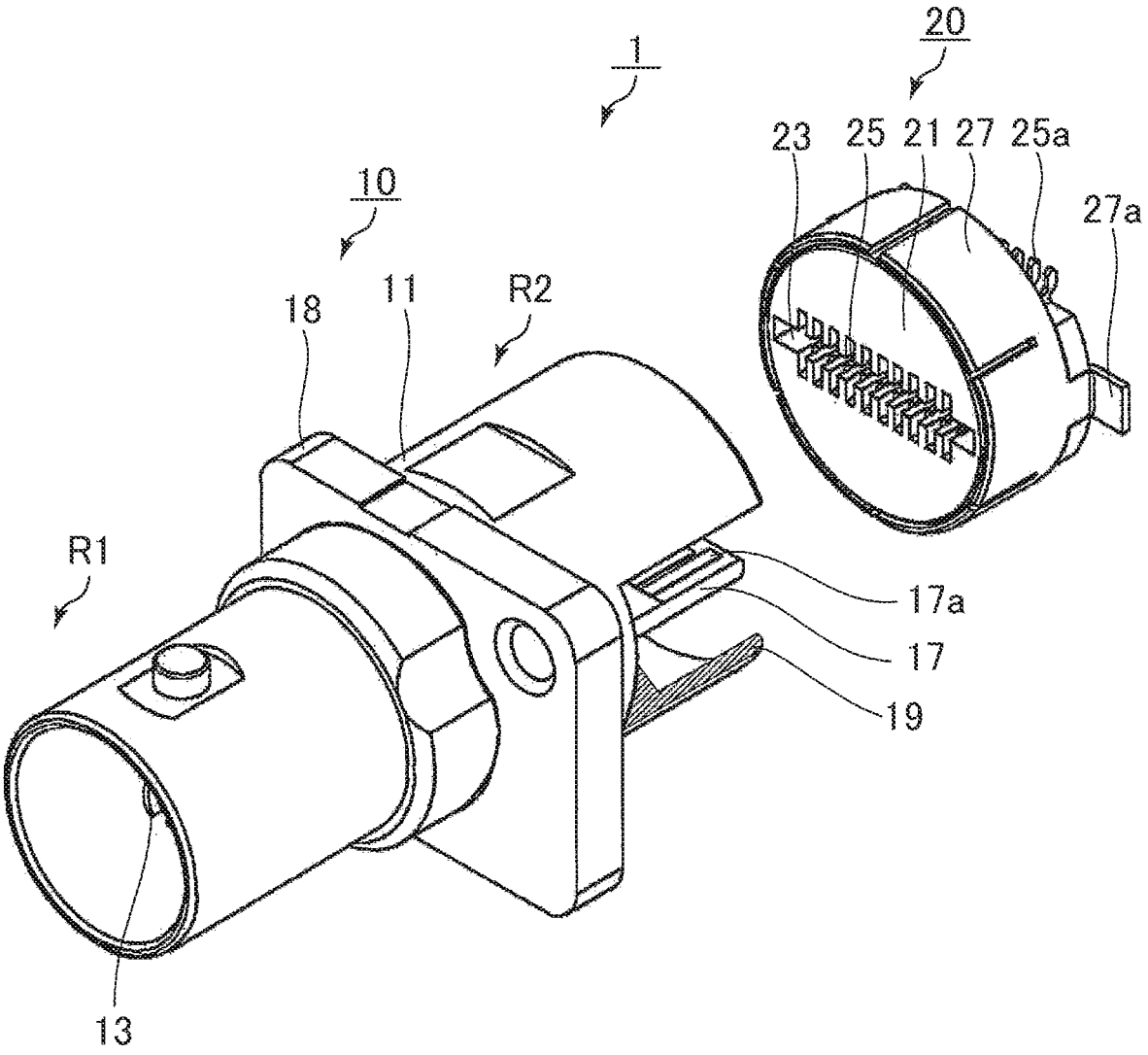
FIG. 1 is a partially cutaway perspective view of an example of a coaxial connector device.
Figure 2:
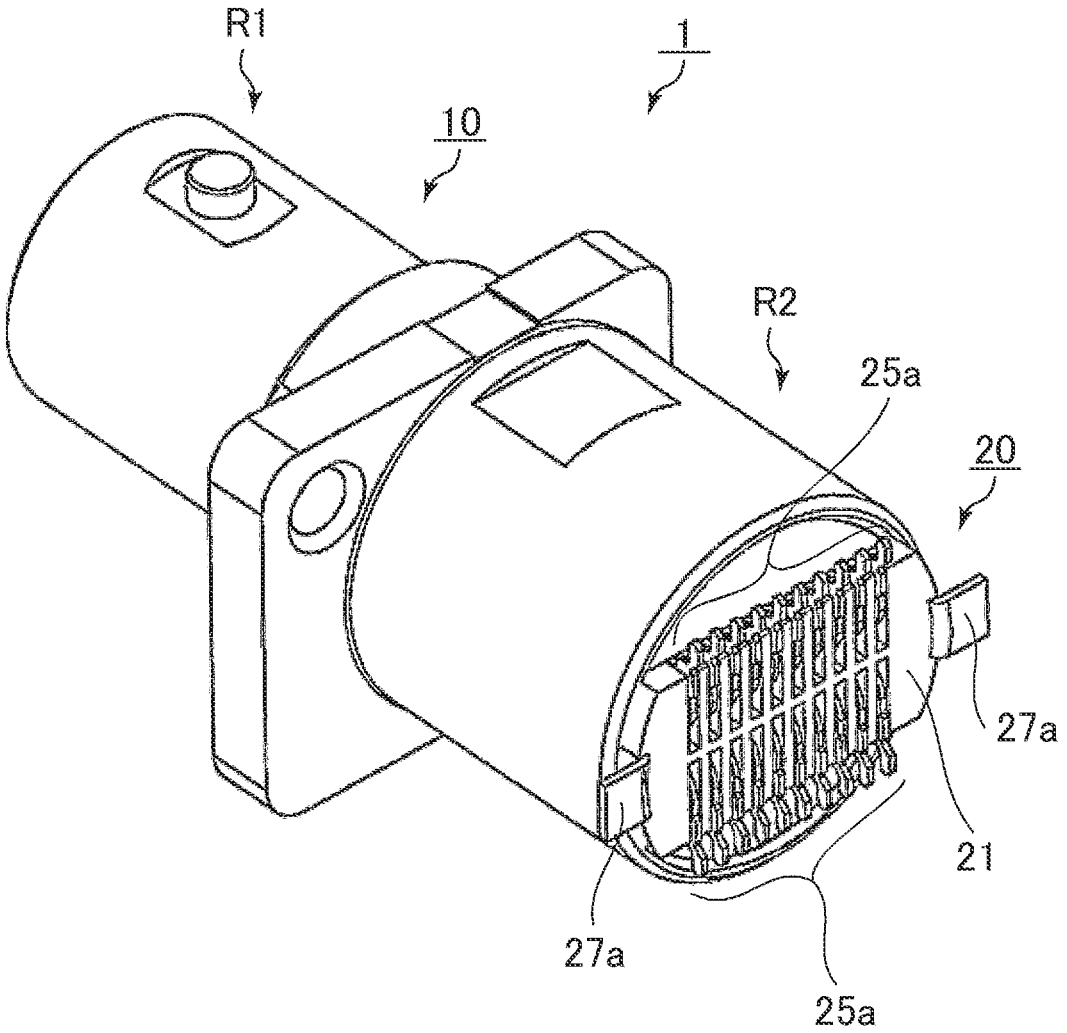
FIG. 2 is a perspective view of an example of a coaxial connector device.
Figure 3:
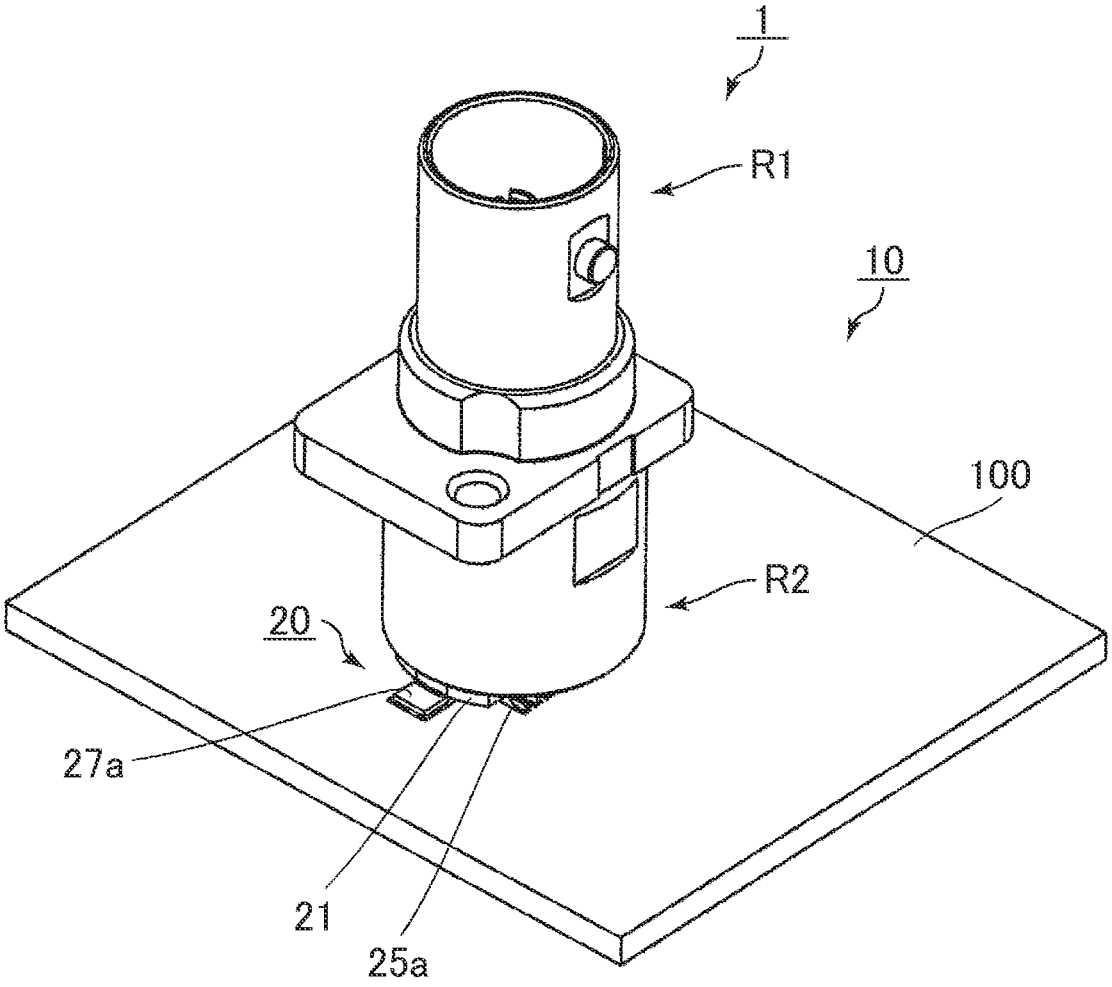
FIG. 3 is a perspective view of the coaxial connector device mounted on a printed circuit board.
Figure 4:
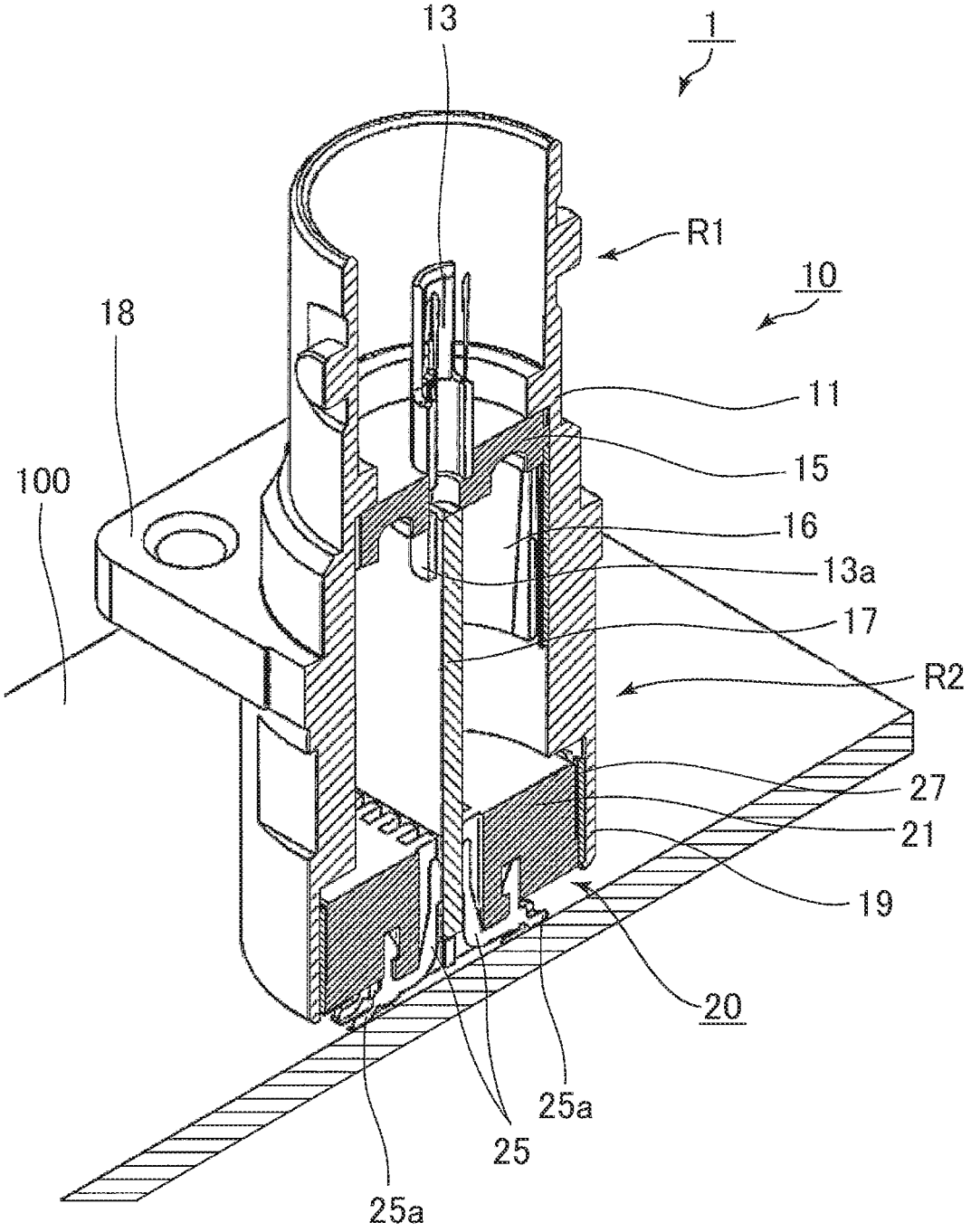
FIG. 4 is a perspective cross sectional view of the coaxial connector device mounted on the printed circuit board.

FIG. 1 is a cutaway perspective view of an example of a coaxial connector device to which the present invention is adapted. FIG. 2 is a perspective view of the coaxial connector device. FIG. 3 is a perspective view of the coaxial connector device mounted on a printed circuit board. FIG. 4 is a perspective cross sectional view of the coaxial connector device mounted on the printed circuit board.

The coaxial connector device according to the embodiment described below is an example of a straight coaxial connector device configured in which a Bayonet Neil-Concelman (BNC) connector plug is fitted to one end of a main connector, a board connector is fitted to the other end of the main connector, the board connector is mounted on a printed circuit board, and the BNC connector plug and the main connector are plugged in and unplugged vertically relative to one face of the printed circuit board. Note that this is a mere example, and the present invention is not limited to this.

Referring to FIGS. 1 to 4, a coaxial connector device 1 has a main connector 10 and a board connector 20. The main connector 10 includes a conductive main connector body 11, a center contact 13, and a card edge substrate 17. The main connector body 11 has a fitting part R1 (corresponding to a first fitting part) for a BNC connector plug at one end, and a fitting part R2 (corresponding to a second fitting part) at the other end. The center contact 13 is positioned, inside the main connector body 11, on a side with the plug fitting part R1. The card edge substrate 17 is positioned, inside the main connector body 11, on a side with the second fitting part R2, and is electrically connected to the center contact 13. The card edge substrate 17 is electrically connected to the center contact 13, and a plurality of substrate contacts 17*a* is formed on at least one face or both faces of the card edge substrate 17. A fitting end 19 of the second fitting part R2 has a cylindrical inner face that is to contact the face of an outer conductor contact 27 of the board connector 20, which will be described later. Note that a fixing part 18 of the main connector body 11 is provided to fix the fixing part 18 to a cabling panel (not shown) of an apparatus (not shown) with a screw in mounting the coaxial connector device 1 on the apparatus like broadcasting equipment, for example.

Referring to FIG. 4, the center contact 13 is supported by an insulating member 15 in an electrically insulating manner with respect to the main connector body 11 of the main connector 10. The center contact 13 has a female contact part on one end (on the first fitting part R1 side), and a connecting part 13*a* to the card edge substrate 17 on the other end. The connecting part 13*a* contacts the card edge substrate 17, and then the connecting part 13*a* is electrically connected to the card edge substrate 17.

Figure 5:
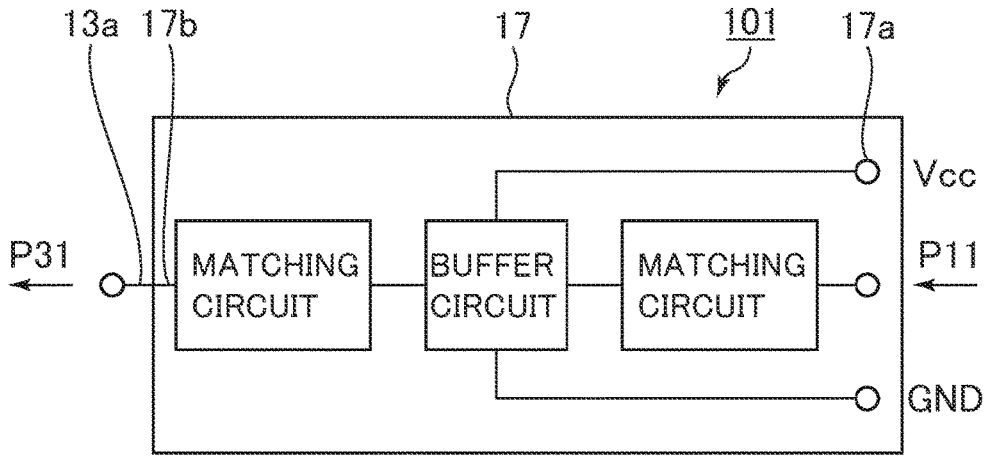
FIG. 5(A)-(B) shows block diagrams of examples of active circuits mounted on the card edge substrate of a main connector.
Figure 5:
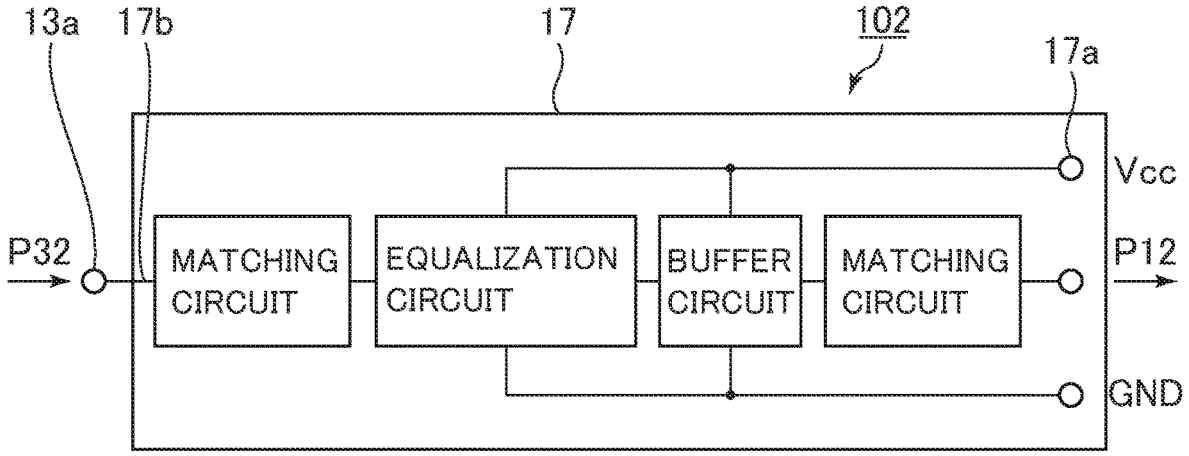

On at least one face or both faces of the card edge substrate 17, at least one wiring 17*b* that electrically connects the connecting part 13*a* of the center contact 13 to the plurality of substrate contacts 17*a* may be included (see FIG. 5). In the midway point of the wiring 17*b* of the card edge substrate 17, at least one active circuit may be included. In other words, a function as an active connector may be additionally provided for the main connector 10 by implementing one or more active circuits on the card edge substrate 17.

FIG. 5 is a block diagram of at least two examples of active circuits mounted on the card edge substrate 17. Note that FIG. 5 shows mere examples, and the active circuit is not limited thereto. In a block diagram shown in FIG. 5(A), the active circuit included in the midway point of the wiring 17*b* of the card edge substrate 17 is an active circuit 101 which includes a first matching circuit on the substrate contact 17*a* side, a second matching circuit on the connecting part 13*a* side of the center contact, and a buffer circuit provided between the first and the second matching circuits. In this example, the plurality of substrate contacts 17*a* to which the wiring 17*b* is connected includes a supply terminal of a direct-current voltage Vcc, an input terminal of an input signal P11, and a GND terminal. To the connecting part 13*a* of the center contact 13 to which the wiring 17*b* is connected, an output signal P31 is supplied. The buffer circuit is driven by the direct-current voltage Vcc supplied from the apparatus side. The buffer circuit has a function that prevents mutual influence between the input signal P11 and the output signal P31. The main connector 10 built-in the card edge substrate 17 mounted with the active circuit 101 shown in FIG. 5(A) is suited as an active connector that is applied to an apparatus on the transmitting end.

In a block diagram shown in FIG. 5(B), the active circuit included in the midway point of the wiring 17*b* in the midway point of the wiring 17*b* of the card edge substrate 17 is an active circuit 102 which includes a first matching circuit on the substrate contact 17*a* side, a second matching circuit on the connecting part 13*a* side of the center contact, and an equivalent circuit and a buffer circuit provided between the first and the second matching circuits. In this example, the plurality of substrate contacts 17*a* to which the wiring 17*b* is connected includes a supply terminal of the direct-current voltage Vcc, an output terminal of an output signal P12, and a GND terminal. From the wiring 17*b* connected to the connecting part 13*a* of the center contact 13, an input signal P32 is supplied. The buffer circuit is driven by the direct-current voltage Vcc supplied from the apparatus side. The buffer circuit has a function that prevents mutual influence between the output signal P12 and the input signal P32. The equivalent circuit has a function that corrects the frequency characteristics and/or the loss of the coaxial cable that is a transmission line. The equivalent circuit is also driven by the direct-current voltage Vcc supplied from the apparatus side. The main connector 10 that incorporates the card edge substrate 17 implementing the active circuit 102 shown in FIG. 5(B) thereon is suited as an active connector that is applied to an apparatus on the receiving end.

Again referring to FIG. 4, the card edge substrate 17 is mechanically supported by a support member 16 provided on a side with the second fitting part R2 of the main connector body 11 of the main connector 10 and mechanically fixed inside the second fitting part R2. Note that the support member 16 may be formed of a conductive material having a desired mechanical strength such that the end portion of the card edge substrate 17 can be stably plugged in and unplugged from a slot 23 of the board connector 20 (described later with reference to FIG. 1).

Referring to FIGS. 1 to 4, the board connector 20 has a board connector body 21 and an outer conductor contact 27.

In the board connector body 21 a slot 23 is formed. In the slot 23 a plurality of inner contacts 25 is provided. The board connector body 21 has a short columnar outer shape. The slot 23 is formed such that, when the board connector 20 is mounted on the printed circuit board 100, the slot 23 is oriented perpendicularly to one face of the printed circuit board 100. On the outer part of the board connector body 21, the outer conductor contact 27 is provided, and fixed to the board connector body 21. The outer conductor contact 27 may include a conductive spring member. Each of the plurality of inner contacts 25 of the board connector body 21 has connection terminals 25*a*, and the outer conductor contact 27 has connection terminals 27*a*. The connection terminals 25*a* and 27*a* extend from the bottom part or the bottom face of the board connector body 21 in the width direction of the board connector.

Referring to FIGS. 3 and 4, the board connector 20 configured as described above can be mounted on one face of the printed circuit board 100. The connection terminals 25*a* and 27*a* of the board connector 20 can be configured such that, when the board connector 20 is mounted on the surface of the printed circuit board 100, the terminals 25*a* and 27*a* are connected to wirings (not shown) on the printed circuit board 100. Therefore, the board connector 20 can be mounted on the printed circuit board 100 without causing stub formation. Note that for this mounting work, reflow soldering can be used. Conventionally, mounting work needs manual soldering. However, according to the embodiment, the working efficiency can be improved.

In the coaxial connector device 1, the main connector 10 is configured detachably from the board connector 20. When the second fitting part R2 of the main connector 10 is fitted to the board connector 10, the end portion of the card edge substrate 17 is coupled to the slot 23 of the board connector body 21, the plurality of substrate contacts 17*a* of the card edge substrate 17 electrically contacts the plurality of inner contacts 25 of the board connector body 21, and the second fitting part R2 of the main connector 10 electrically contacts the outer conductor contact 27. In the case in which the outer conductor contact 27 includes a conductive spring member, when the face of the outer conductor contact 27 contacts the cylindrical inner face of the fitting end 19 of the second fitting part R2, the spring elasticity of the outer conductor contact 27 advantageously works to make electrical connection and mechanical coupling between them more stable.

As described above, the example of a straight coaxial connector device is described as an example of the embodiment. In the following, as another example of the embodiment, an example of a right angle coaxial connector device will be described with reference to the drawings. The right angle coaxial connector device is configured such that a BNC connector plug and a main connector can be horizontally plugged in and unplugged from one face of a printed circuit board.

Figure 6:
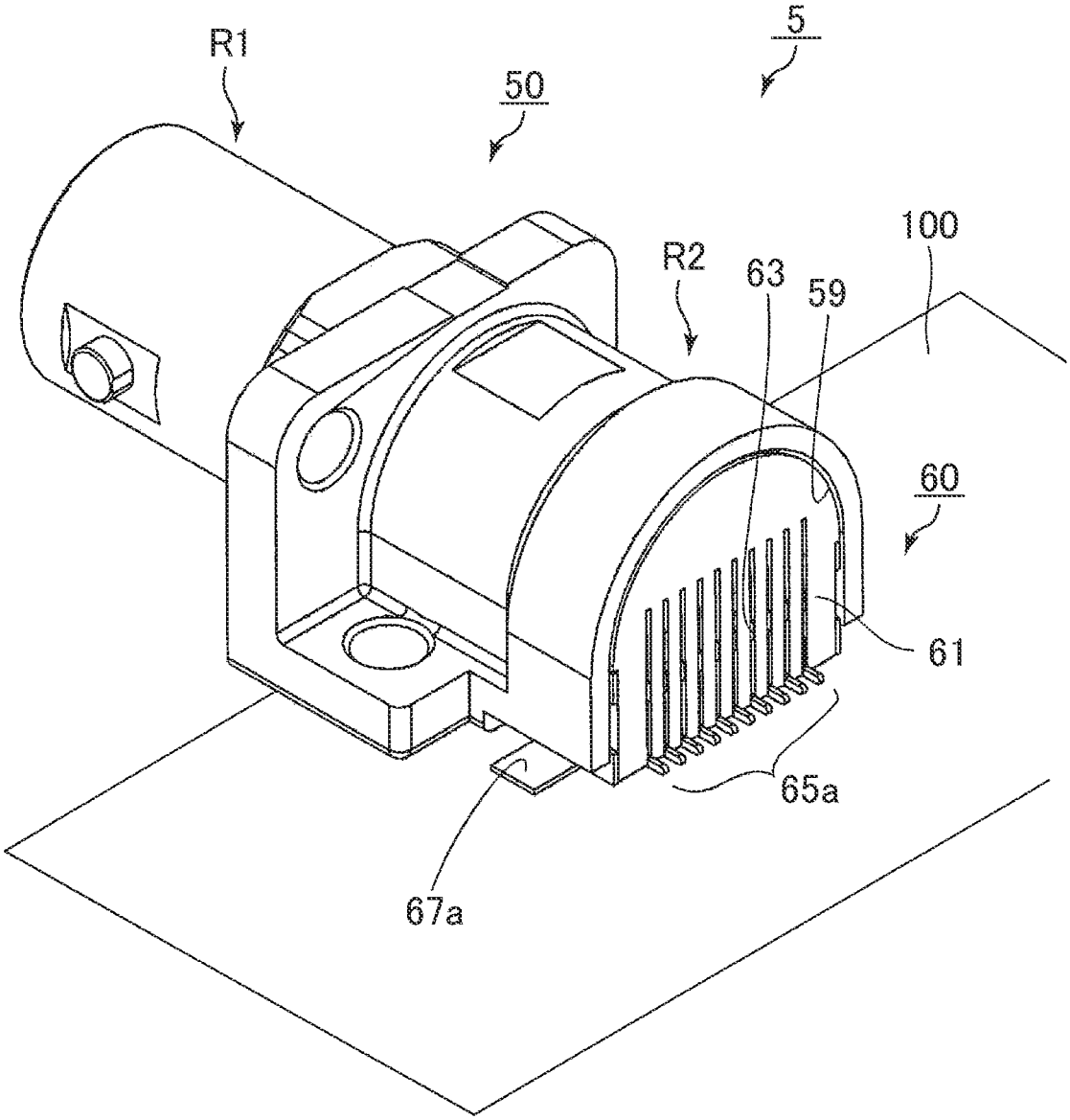
FIG. 6 is a perspective view of another example of a coaxial connector device mounted on a printed circuit board.
Figure 7:
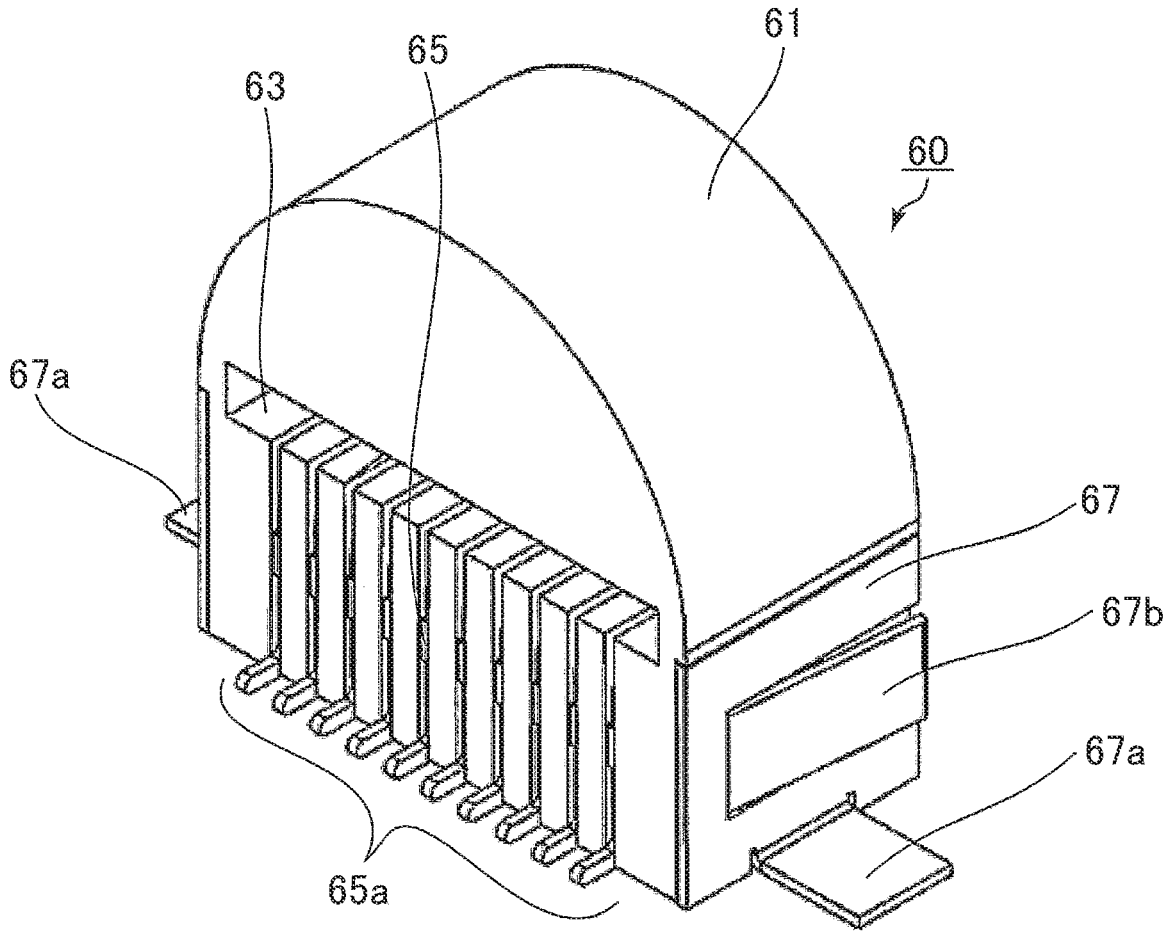
FIG. 7 is a perspective view of an example of board connector in another example of the coaxial connector device.
Figure 8:
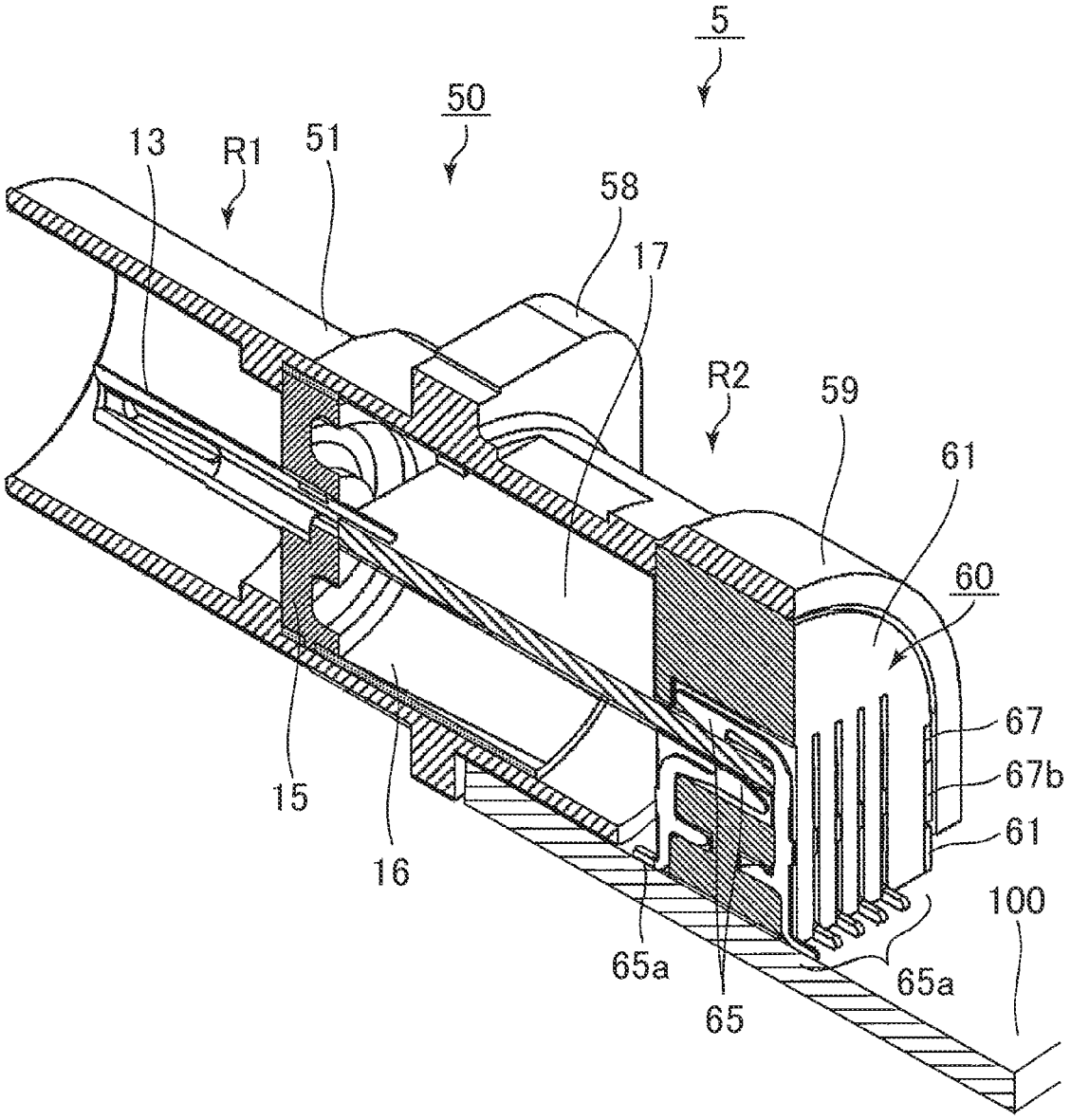
FIG. 8 is a perspective cross sectional view of the coaxial connector device mounted on a printed circuit board.
Figure 9:
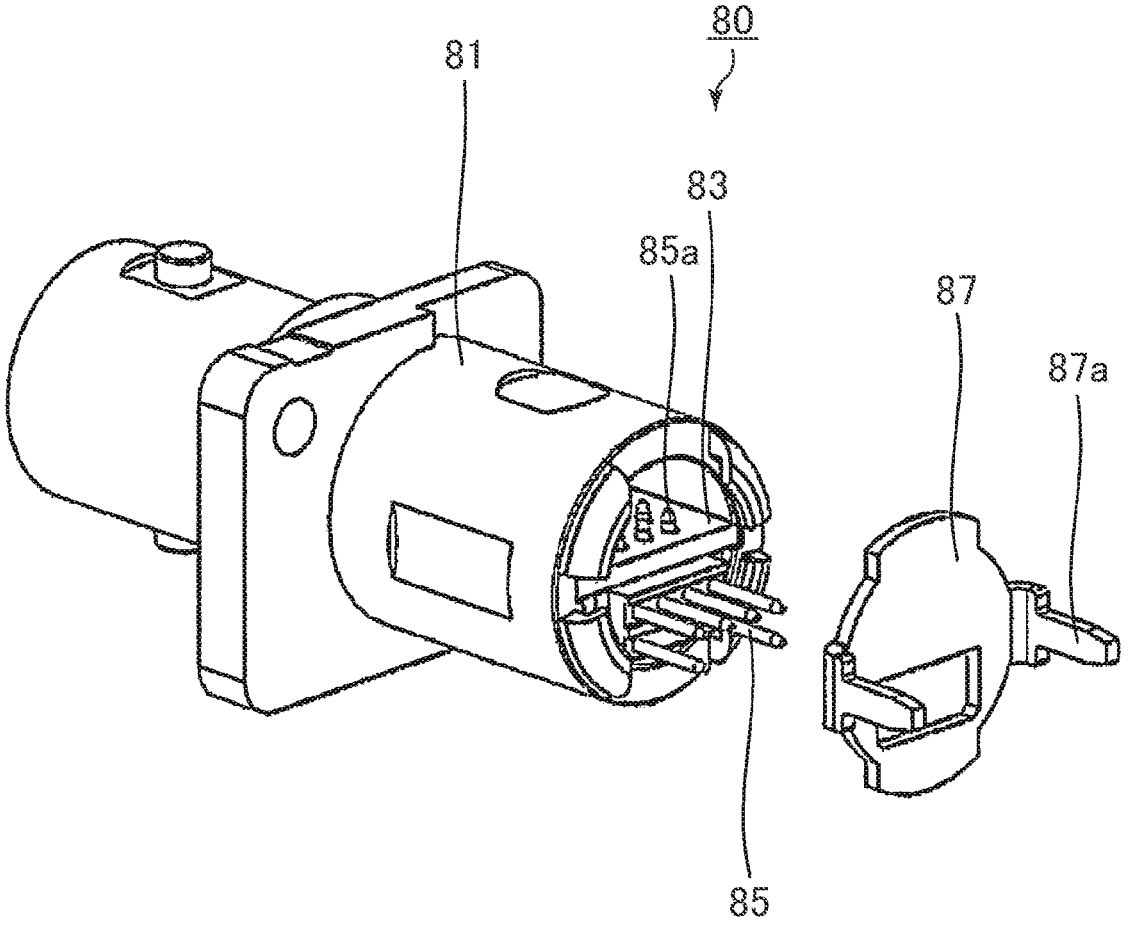
FIG. 9 is a perspective view of an exemplary configuration of a previously existing active connector.

FIG. 6 is a perspective view of an example of a right angle coaxial connector device. FIG. 7 is a perspective view of an example of aboard connector preferably used for the right angle coaxial connector device. FIG. 8 is a perspective cross sectional view of the right angle coaxial connector device mounted on a printed circuit board. In these drawings, constituent parts similar to those of the straight coaxial connector device illustrated in FIGS. 1 to 4 are designated with the same reference signs.

Referring to FIGS. 6 to 8, a right angle coaxial connector device 5 has a main connector 50 and a board connector 60. The main connector 50 includes a conductive main connector body 51 having a fitting part R1 for BNC connector plug at one end, and a fitting part R2 at the other end, a center contact 13, and a card edge substrate 17. The center contact 13 is positioned, inside the main connector body 51, on a side with the plug fitting part R1. The card edge substrate 17 is positioned, inside the main connector body 51, on a side with a second fitting part R2, and is electrically connected to the center contact 13. A fitting end 59 of the second fitting part R2 has a semi-cylindrical inner face that is to contact with the face of an outer conductor contact 67 of the board connector 60, which will be described later. A fixing part 58 of the main connector body 51 is provided to fix the fixing part 58 to a cabling panel (not shown) of an apparatus (not shown) and a printed circuit board 100 with screws in mounting the coaxial connector device 5 on the apparatus like broadcasting equipment, for example.

The board connector 60 has a board connector body 61 and an outer conductor contact 67. In the board connector body 61 a slot 63 is formed. In the slot 63 a plurality of inner contacts 65 is provided. Unlike the board connector 20 of the straight coaxial connector device 1 illustrated in FIGS. 1 to 4, the board connector body 61 of the board connector 60 of the right angle coaxial connector device 5 has a short semi-columnar outer shape (an inverted U-shape). The slot 63 is formed such that, when the board connector 60 is mounted on the printed circuit board 100, the slot 63 is oriented in parallel with one face of the printed circuit board 100. On the outer part of the board connector body 61, the outer conductor contact 67 is provided and fixed to the board connector body 61. The outer conductor contact 67 may include a conductive spring member. Each of the plurality of inner contacts 65 of the board connector body 61 has connection terminals 65*a*, and the outer conductor contact 67 has connection terminals 67*a*. The connection terminals 65*a* and 67*a* extend from the bottom part or the bottom face of the board connector body 61 in the width direction of the board connector.

The connection terminals 65*a* and 67*a* of the board connector 60 can be configured such that, when the board connector 60 is mounted on the surface of the printed circuit board 100, the terminals 65*a* and 67*a* are connected to wirings (not shown) on the printed circuit board 100. Therefore, the board connector 60 can be mounted on the printed circuit board 100 without causing stub formation. Reflow soldering can be used for this mounting work, which is similar to the case of the board connector 20 described above.

In the coaxial connector device 5, the main connector 50 is configured detachably from the board connector 60. When the second fitting part R2 of the main connector 50 is fitted to the board connector 60, the end portion of the card edge substrate 17 is coupled to the slot 63 of the board connector body 61, the plurality of substrate contacts 17*a* of the card edge substrate 17 electrically contacts the plurality of contacts 65 of the board connector body 61, and the second fitting part R2 of the main connector 51 electrically contacts the outer conductor contact 67. In the case in which the outer conductor contact 67 includes a conductive spring member (e.g. spring parts 67*b* illustrated in FIGS. 7 and 8), when the face of the outer conductor contact 67 contacts the semi-cylindrical inner face of the fitting end 59 of the second fitting part R2, the spring elasticity of the outer conductor contact 67 advantageously works to make electrical connection and mechanical coupling between them more stable.

In the description of the embodiment based on at least two examples, the examples in which the fitting end of the second fitting part of the main connector body has the cylindrical inner face or the semi-cylindrical inner face and the board connector body has a short columnar outer shape or a short semi-columnar outer shape (an inverted U-shape) are described. These are mere examples. The fitting end of the second fitting part may have a differently shaped inner face and the board connector body may have a different outer shape. In the description of the embodiment, an example is described in which the main connector functions as the active connector including the active circuit in the midway point of the wiring of the card edge substrate. This is a mere example. The main connector may be a so-called passive connector in which only a wiring is formed and no active circuit is included in the card edge substrate.

The coaxial connector device according to the present invention is specifically effective at input end or output end of various apparatus that transmit signals or electric power using a transmission line (broadcasting equipment, video and audio equipment, signal transmission terminals, signal receiving terminals, relay devices, and any other devices) when it is necessary to satisfy high-level requirements for the signal quality and transmission characteristics at high frequencies.

INDUSTRIAL APPLICABILITY

The present invention is widely applicable to coaxial connector devices for electrically connecting a coaxial cable attached with a connector and a printed circuit board.

REFERENCE SIGNS LIST

1, 5: coaxial connector device
10, 50: main connector
11, 51: main connector body
13: center contact
13*a*: connecting part
15: insulating member
16: support member
17: card edge substrate
17*a*: substrate contact
17*b*: wiring
18, 58: fixing part
19, 59: fitting end
20, 60: board connector
21, 61: board connector body
23, 63: slot
25, 65: inner contact
27, 67: outer conductor contact
25*a*, 27*a*, 65*a*, 67*a*: connection terminal
67*b*: spring part
R1: first fitting part
R2: second fitting part

The invention claimed is:

1. A coaxial connector device for electrically connecting a coaxial cable connector and a printed circuit board, the device comprising:
- a main connector; and
- a board connector to be mounted on a printed circuit board,
- the main connector including
  - a conductive main connector body having a first fitting part for a coaxial cable connector at one end and a second fitting part at the other end;
  - a center contact positioned, inside the main connector body, on a side with the first fitting part; and
  - a card edge substrate positioned, inside the main connector body, on a side with the second fitting part, the card edge substrate being electrically connected to the center contact,
- the board connector including
  - a board connector body in which a slot is formed, the board connector body being provided with a plurality of contacts in the slot; and
  - an outer conductor contact provided in the board connector body,
- wherein, when the second fitting part of the main connector is fitted to the board connector, an end portion of the card edge substrate is coupled to the slot in the board connector body, a plurality of substrate contacts included in the card edge substrate electrically contact the plurality of contacts of the board connector body, and the second fitting part of the main connector body electrically contacts the outer conductor contact.

2. The coaxial connector device according to claim 1, wherein the second fitting part has an inner face that contacts at least the outer conductor contact when the second fitting part is fitted to the board connector.

3. The coaxial connector device according to claim 2, wherein the inner face of the second fitting part of the main connector is cylindrical or semi-cylindrical, and the outer conductor contact of the board connector includes a spring member provided outside the board connector body.

4. The coaxial connector device according to claim 3, wherein each of the plurality of contacts of the board connector and the outer conductor contact have a connection terminal extending from a bottom part or bottom face of the board connector body in a width direction of the board connector.

5. The coaxial connector device according to claim 4, wherein the connection terminals of the board connector are configured such that when the board connector is mounted on a surface of a printed circuit board, the connection terminals are connected to respective wirings on the printed circuit board.

6. The coaxial connector device according to claim 1, wherein the card edge substrate of the main connector includes at least one active circuit.

7. The coaxial connector device according to claim 6, wherein the active circuit includes at least a first matching circuit, a second matching circuit connected to the center contact, and a buffer circuit provided between the first matching circuit and the second matching circuit.

8. The coaxial connector device according to claim 1, wherein the slot of the board connector is formed such that, when the board connector is mounted on a printed circuit board, the slot is oriented at a predetermined angle with respect to one face of the printed circuit board or in parallel with the one face of the printed circuit board.

* * * * *